United States Patent [19]

Shaeffer

[11] Patent Number: 4,920,674

[45] Date of Patent: May 1, 1990

[54] INFLATABLE COMMUNICATION DEVICE

[76] Inventor: Henry W. Shaeffer, 825 Elyria Dr., Los Angeles, Calif. 90065

[21] Appl. No.: 270,791

[22] Filed: Nov. 14, 1988

[51] Int. Cl.[5] ..... G09F 19/08

[52] U.S. Cl. ..... 40/412; 40/214; 116/210; 446/220

[58] Field of Search ..... 40/214, 215, 412; 446/220, 148; 116/210, DIG. 9; 441/30

[56] References Cited

U.S. PATENT DOCUMENTS

| | | | |
|---|---|---|---|
| 3,563,676 | 2/1971 | Coovert et al. | 446/220 |
| 3,938,466 | 2/1976 | Crissman | 116/210 |
| 4,020,786 | 5/1977 | Kopeika | 116/210 |
| 4,447,974 | 5/1984 | Vicino et al. | 40/214 |
| 4,703,573 | 11/1987 | Montgomery et al. | 40/455 |
| 4,784,628 | 11/1988 | McArdle et al. | 446/222 |

*Primary Examiner*—Cary E. Stone

*Attorney, Agent, or Firm*—Thomas A. Turner, Jr.

[57] ABSTRACT

A self-inflatable balloon has a communication discernible on its surface and has its mouth opening pneumatically sealed to a funnel through which air is selectively directed upon actuation of a triggering event. Audible communication may also be actuated by the same or a different triggering event. A method of communicating comprises a message which becomes cognizable upon inflation of a message carrying device.

5 Claims, 2 Drawing Sheets

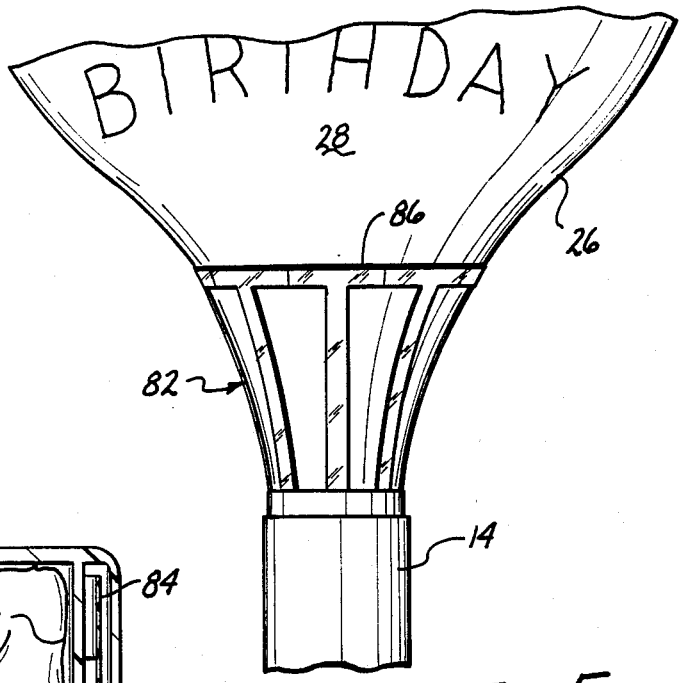
FIG. 5
FIG. 4
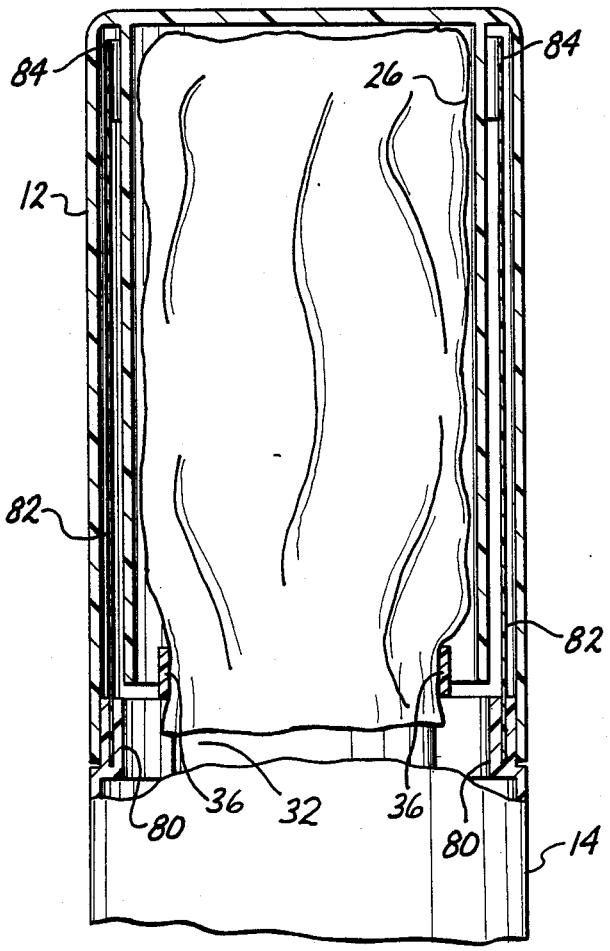

INFLATABLE COMMUNICATION DEVICE

BACKGROUND OF THE INVENTION

1. Field of the Invention

The present invention relates to the art of communicating, and more particularly to selectively self-inflatable devices.

2. Description of the Prior Art

In the past, messages that become discernible only to a recipient upon performing some act have been known. For example, it has been known to provide message cards which, upon opening the leaves of the card, a switch is actuated to start a programmable read only memory (PROM) driving a sound synthesizer to form an audible message. Other types of message cards may employ a foldable structure of paper or cardboard which folds into a particularly predetermined shape upon opening the leaves of the card.

What is desired, however, is a three dimensional message arrangement actuable upon opening some container or card having automatic means for resulting in an enlarged, with respect to the size of the container, message which is self producing after opening the container.

SUMMARY

In brief, in accordance with one aspect of the present invention, a self contained kit or unit is provided having an inflatable balloon deflated and contained therewithin. The balloon is attached pneumatically through an actuable valve to the opening of a funnel within which a turbine, when rotating, creates an air pressure to force air through the funnel and into the balloon. The turbine is driven by a coaxial motor energized by a battery, all placed within the container.

The container has appropriate openings to receive air from the ambient supply, and may also contain a sound synthesizer sufficient to provide a predetermined audible message. The balloon comprises a relatively smooth surface on which a message or other graphic material may be imprinted so that it is discernible when the balloon is inflated.

In an alternative embodiment, a set of expansive stays are positioned within the assembly to expand and to engage the balloon when the cap is removed and are used to stabilize the balloon in the inflated state.

The motor is actuated when the lid of the container is removed and a valve is turned to close an electrical power circuit which includes a battery. In an alternative, the battery may be separate from the initial assembly, and the electrical power circuit is closed when the battery or other electrical power source is applied in the invention. The kit may be provided assembled or may be provided in component parts for assembly by the user.

Other novel features which are believed to be characteristic of the invention, both as to organization and methods of operation, together with further objects and advantages thereof, will be better understood from the following description in which preferred embodiments of the invention are described by way of example.

BRIEF DESCRIPTION OF THE DRAWINGS

FIG. 4 is cross-sectional view of the cap in the enclosed position having stays showing an alternative embodiment of the invention; and FIG. 5 is a side elevational view of the alternative embodiment of FIG. 4 shown in operation.

DESCRIPTION OF THE PREFERRED EMBODIMENTS

Figure 1:
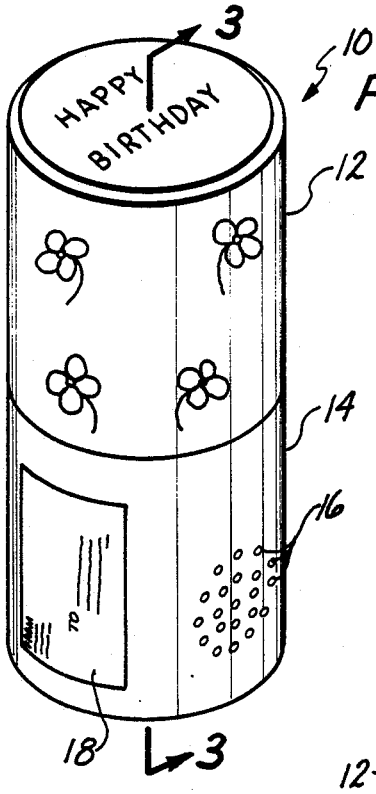
FIG. 1 is a perspective of the preferred embodiment of the invention assembled and prepared for transport.

A container 10, reference being had initially to FIG. 1 of the accompanying drawings, is shown comprising the preferred embodiment of the present invention. The container 10 may comprise the components of a kit for assembly into the preferred embodiment of the present invention. The container 10 is comprised of an upper, cylindrical enclosure 12 or cap, and a lower enclosure or housing 14 for housing the operative elements of the preferred embodiment of the present invention. The container may also have perforations or openings 16 in its cylindrical side to allow sounds or air to pass, as will be described in greater detail below. The cyclindical side of the container 10 may also contain a surface 18 adapted for encoding or placing some important information, such as, for example, an address.

Figure 2:
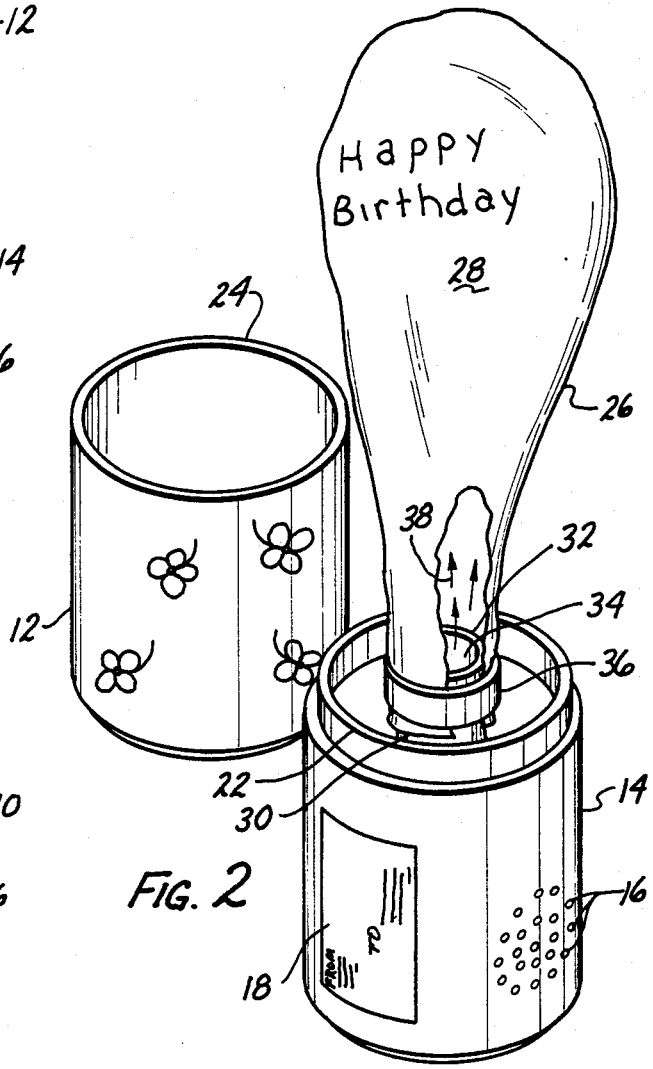
FIG. 2 is a perspective of the preferred embodiment of the invention as seen in FIG. 1, having an enclosure removed and the message surface being inflated for discernment without a portion cut away for clarity in description.

In FIG. 2, the container 10 has its upper enclosure 12 removed or separated from the lower enclosure 14. The lower enclosure 14 has an upper lip 22 with a diameter slightly less than the rim 24 of the upper enclosure 12 in order to hold the removed.

As seen in FIG. 2, the balloon 26 is shown partially inflated or in the process of being inflated. The balloon 26 has a smooth surface 28 on which a message or graphic material may be depicted, and which is not ordinarily discernible until the balloon 26 is inflated. The balloon has a mouth or opening 30 which is secured to a nozzle 32 defining an opening 34 of the lower enclosure 14, as will be described in greater detail below. The mouth 30 of the balloon 26 may be secured to the nozzle 32, and in pneumatic connection with the opening 34 by means of a sealing ring 36. Alternatively, the mouth 30 may merely be glued to the nozzle 30, thus to create the generally air tight seal between the interior of the balloon 26 and the opening 34.

Turning now to the lower enclosure 14, seen best in the cross-sectional view of FIG. 3, the nozzle 32 comprises the upper opening 34 of the valve 42, which in the preferred embodiment is manually operated, as will be explained in greater detail below. The valve 42 has an intake port 44 receiving the nozzle 46 from the funnel 48. The funnel 48 is in integral construction with the nozzle 46, channeling air into the valve 42, and ultimately into the balloon 26 through the opening 34 when in operation.

Figure 3:
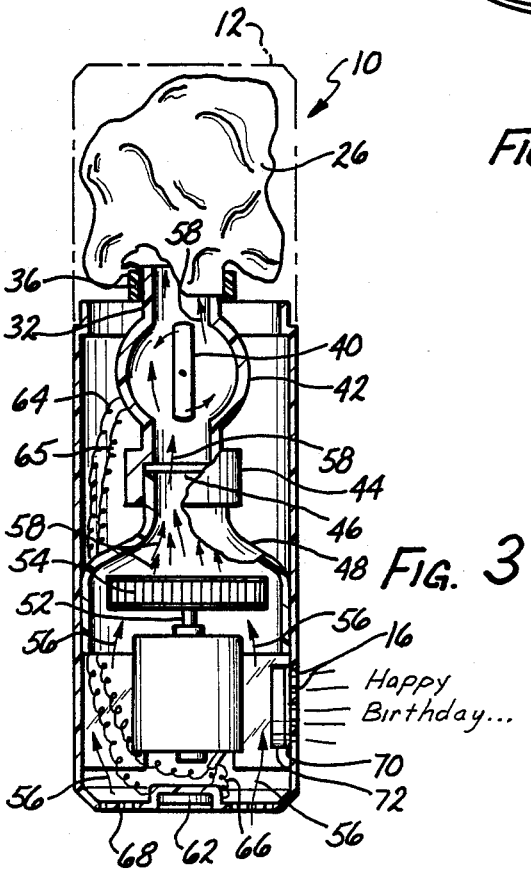
FIG. 3 is a side elevation, cross-sectional view of the preferred embodiment of the invention of FIG. 1, showing the components assembled and the upper enclosure in phantom.

In FIG. 3, the means for inflating the balloon 26 is shown, where the upper cap 12 is shown in phantom for ease in understanding the present invention. The balloon 26 is deflated and contained within the cap 12. The opening or mouth 30 of the balloon 26 is held tightly around or over the nozzle 32 of the valve 42, which is in selective pneumatic connection with the opening of the nozzle 46 of funnel 48. The valve includes a flap or plug 40 which is rotated around a center. When the outer edges of the flap 40 is in the position shown in FIG. 3, air can flow in the direction of arrows 58. When, however, the flap 40 is rotated in the direction of the arrows as indicated so that the edges of the flap 40 engage the interior wall of the valve 42, the air passage way is sealed and air cannot flow in the directions of the arrows 56, 58.

Within the lower enclosure 14, a motor 50 is provided having drive axle 52 to which an air turbine 54 is attached for rotational driving. The turbine 54 has veins, blades or propellers which are aerodynamically designed to direct air in the direction of arrows 56, 58 when rotating. The motor 50 is powered by the battery 62 or other source of electrical energy power, which is connected selectively in circuit to the motor 50 by leads 64, 65, 66. Openings 68 are provided in the lower enclosure 14, to allow air to be driven therethrough in the direction of arrows 56 when the turbine 54 is actuated. The leads 64, 65 provide one circuit connection of the battery 62 to the motor 50 by way of a switch in valve 42, so that when the flap 40 is opened in the position shown in FIG. 3, the circuit of leads 64, 65, 66 is electrically closed provided that a battery 62 and a motor 50 are in place.

In an alternative embodiment, the leads 64, 65 may be fixed in a closed circuit, and the circuit providing electrical power to the motor 50 is closed when battery 62 is assembled within the lower compartment 14.

In an further alternative embodiment of the present invention, a sound synthesizer is provided comprising a piezoelectric speaker 70 integrally connected to PROM 72. The PROM 72 drives the speaker 70 upon actuation to create sounds in the form of a cognizable message, preferably synchronized with the inflation of the balloon 26.

In operation, the components are assembled within the container 10. The balloon 32 is in its deflated state within the upper enclosure or cap 12, having its mouth or opening 30 in a sealed relationship over the nozzle 32 so that the interior of the balloon 26 is pneumatically connected with the nozzle 46 of the funnel 48 through the valve 42. A battery 62 is assembled within the lower enclosure 14, and is electrically connected with the motor 50, but in open circuit initially. Upon removal of the cap 12 and the turning or other actuation of the flap 40 of the valve 42 into the open position as shown in FIG. 3, the circuit between the battery 62 and the motor 50 is closed, actuating or driving the motor 50 to drive the turbine 54 through axle 52.

Air then is forced in the direction of arrows 56 through openings 68, and in the direction of arrows 58 through the nozzle 46, through the now opened valve 42 around the flap 40 and into the interior of the balloon 26. The air flow 56, 58 continues on into the interior of the balloon 26 in the direction of arrows 38.

The air flow 56, 58 is held within the desired confinement and channeled by the close fit between the funnel 48 and the interior of the wall comprising the lower enclosure 14, as shown in FIG. 3. The balloon 26 is thus automatically inflated upon actuation or turning of the flap 40 of the valve 42, and the message predetermineably depicted on the balloon's surface 28 becomes discernible to the recipient.

In an alternative embodiment of the present invention, the closing of the circuit including leads 64, 65, 66 when the valve 42 is actuated, allows the battery 62 to drive the PROM 72 which, in turn, drives the piezoelectric speaker 70 to provide an audible message as may be predetermineably programmed on the PROM 72.

In FIG. 4, yet another alternative embodiment to the present invention is shown where the cap 12 is in the closed position covering the balloon 26 attached to the lower enclosure 14 by way of the nozzle 32, as explained above in connection with FIGS. 2 and 3. The lower enclosure 14 comprises a rim 80 holding stays 82.

The stays 82 are biased to have the upper edges 84 expand slightly outwardly away from the balloon 26 when the cap 12 is removed, as depicted in FIG. 5. The upper edges 84 of the stays 82 are connected by an expandable rim 86 to hold the upper edges 84 together. The rim 86 engages the side of the balloon 26 to provide support to the upright position of the balloon 26 when the balloon 26 is inflated.

The operation of the invention is generally the same as described above for the embodiment of FIGS. 1, 2 and 3. When the cap 12 is removed, the upper edges, 84 of the stays 82 will expand outwardly from the balloon 26. When the flap 40 is opened in valve 42, further, the expanding balloon 26 engages the stays 82 and the upper rim 86. The stays 82 and rim 86 help to prevent the balloon 26 in the expanded state from tipping over.

The foregoing detailed description of my invention and of preferred embodiments, as to products, compositions and processes, is illustrative of specific embodiments only. It is to be understood, however, that additional embodiments may be perceived by those skilled in the art. The embodiments described herein, together with those additional embodiments, are considered to be within the scope of the present invention.

I claim:

1. In combination, an assembly comprising:

(a) an inflatable balloon having an interior with an opening capable of being inflated by an introduction of gas;

(b) means for providing pressurized gas adapted to be assembled in pneumatic relation to the opening of said balloon to inflate said balloon upon actuation of switch means, said pressurized gas providing means comprising a turbine in an air flow channel pneumatically connected to the opening of said balloon, and in which channel said turbine compresses gas when rotated; and (c) switch means selectively actuable into an opened positioned and into a closed position and pneumatically connected to said inflatable balloon and to said means for providing pressurized gas, said switch means for opening an air conduit between said pressurized gas means and said balloon when in an opened position, and for sealing said conduit when in a closed position.

2. The assembly of claim 1 further comprising sound synthesizing means for generating a sound in synchronization with the inflation of said balloon.

3. In combination, an assembly comprising:

(a) an inflatable balloon having an interior with an opening capable of being inflated by an introduction of gas;

(b) means for providing pressurized gas adapted to be assembled in pneumatic relation to the opening of said balloon to inflate said balloon upon actuation of switch means;

(c) switch means selectively actuable into an opened positioned and into a closed position and pneumatically connected to said inflatable balloon and to said means for providing pressurized gas, said switch means for opening an air conduit between said pressurized gas means and said balloon when in an opened position, and for sealing said conduit when in a closed position;

(d) a lower enclosure enclosing said assembly; and, (e) self-supporting means extending from said lower enclosure for supporting said balloon when inflated.

4. The assembly of claim 3 wherein said self-supporting means comprises self-supporting stays.

5. The assembly of claim 4 wherein said stays are biased to expand upon inflation of the balloon.

* * * * *